US005661919A

United States Patent [19]

Pryor

[11] Patent Number: 5,661,919

[45] Date of Patent: Sep. 2, 1997

[54] HANDGUN HOLDER

[76] Inventor: Gerald Ray Pryor, 114 West Simmons St., Weatherford, Tex. 76086

[21] Appl. No.: 742,816

[22] Filed: Nov. 1, 1996

[51] Int. Cl.[6] ..... F41A 23/16

[52] U.S. Cl. ..... 42/94; 89/37.04

[58] Field of Search ..... 42/94, 95; 89/37.04

[56] References Cited

U.S. PATENT DOCUMENTS

| | | | |
|---|---|---|---|
| 2,458,608 | 1/1949 | Lea | 42/94 |
| 2,877,689 | 3/1959 | Pribis | 42/94 |
| 4,333,385 | 6/1982 | Culver | 42/94 |
| 4,438,581 | 3/1984 | LaValle | 42/94 |
| 4,548,392 | 10/1985 | Rickling | 269/156 |
| 4,621,563 | 11/1986 | Poiencot | 89/37.04 |
| 4,799,324 | 1/1989 | Nodo | 42/94 |
| 4,819,359 | 4/1989 | Bassett | 42/94 |
| 5,070,636 | 12/1991 | Mueller | 42/94 |
| 5,375,337 | 12/1994 | Butler | 42/94 |

FOREIGN PATENT DOCUMENTS 31040 4/1904 Switzerland .

*Primary Examiner*—J. Woodrow Eldred
*Attorney, Agent, or Firm*—Stephen R. Greiner

[57] ABSTRACT

An adjustable holder for a handgun. The holder includes an elongated base having a U-shaped cross-section. The base has a pair of side walls each with an inwardly projecting free edge. A pair of threaded fasteners are rotatably secured to the side walls in opposition to one another for engaging and clamping the handle of a handgun therebetween. An adjustable support member is slidably secured between the side walls and has a notch at its upper end for receiving the barrel of the handgun. A set screw rotatably secured to the support member for contacting the base and biasing the support member into engagement with the inwardly projecting free edges of the side walls so as to selectively fix the position of the support member on the base.

19 Claims, 2 Drawing Sheets

HANDGUN HOLDER

FIELD OF THE INVENTION

The present invention relates generally to firearm supports.

BACKGROUND OF THE INVENTION

It is often necessary to hold a handgun in a fixed position for the purposes of cleaning, repairing, sighting or discharging such. To this end, handgun vises and holders of varied design have been proposed. Unfortunately, many of these designs, while complex and costly in construction, lack features which permit the orientation of a handgun held therein to be easily adjusted and to readily absorb recoil shocks when the handgun is discharged.

SUMMARY OF THE INVENTION

In light of the problems associated with the prior art, it is a principal object of the invention to provide a device for holding a handgun at an orientation set by a user which is simple in construction, inexpensive in manufacture, and dependable in use.

It is another object of the invention to provide a handgun holder of the type described which is capable of absorbing recoil shocks when the handgun is discharged and transferring said shocks to a supporting surface.

It is a further object of the invention to provide a handgun holder which will universally support all conventional handguns.

Briefly, the handgun holder in accordance with this invention achieves the intended objects by featuring a base having a pair of opposed side walls with inwardly projecting free edges. A pair of set screws are rotatably fastened to the side walls for clamping the handle of a handgun therebetween. A support member, for carrying the barrel of the handgun, is slidably secured at one end between the side walls. A set screw is rotatably fastened to the support member for contacting the base and biasing the support member into engagement with the free edges of the side walls so as to selectively fix the position of the support member relative to the base.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
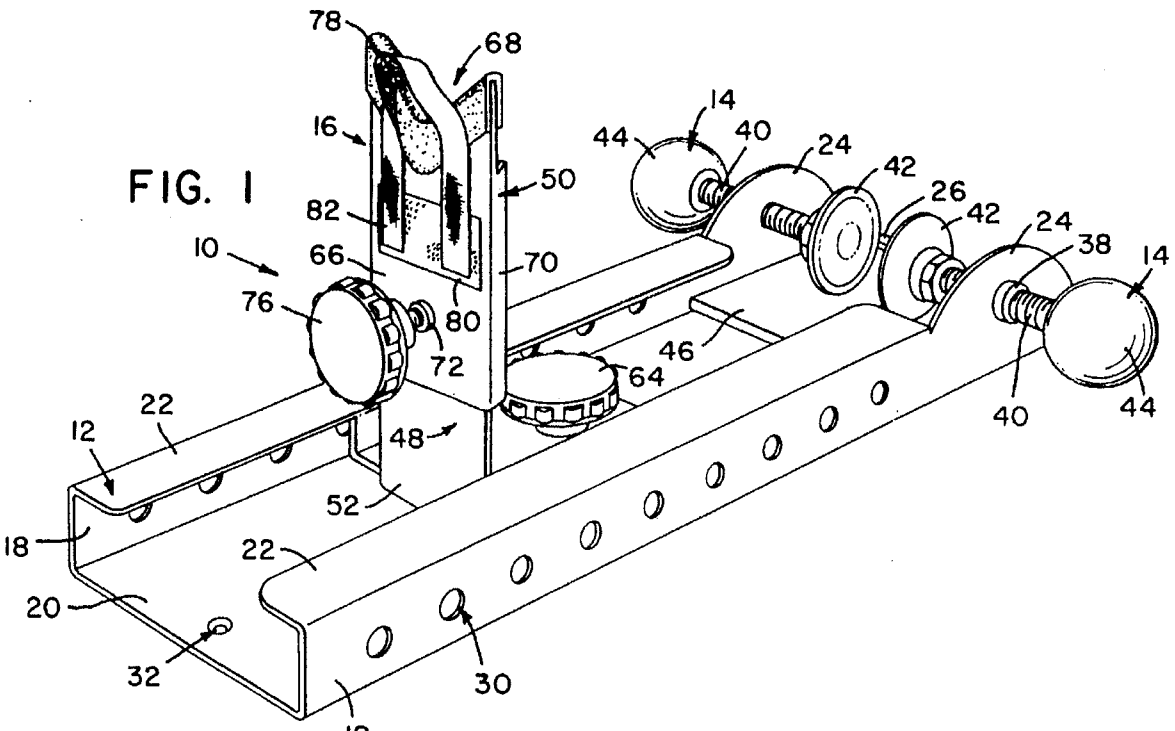
FIG. 1 is a perspective view of a handgun holder in accordance with the present invention.
Figure 2:
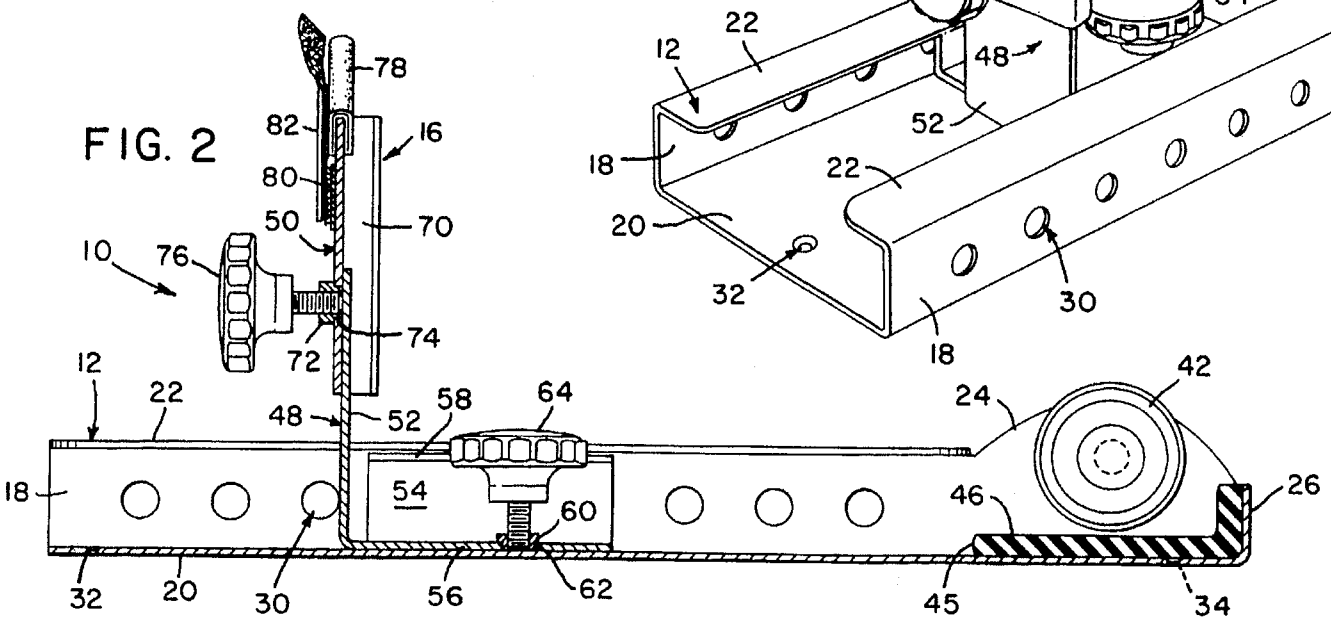
FIG. 2 is a longitudinal cross-sectional view of the handgun holder.
Figure 3:
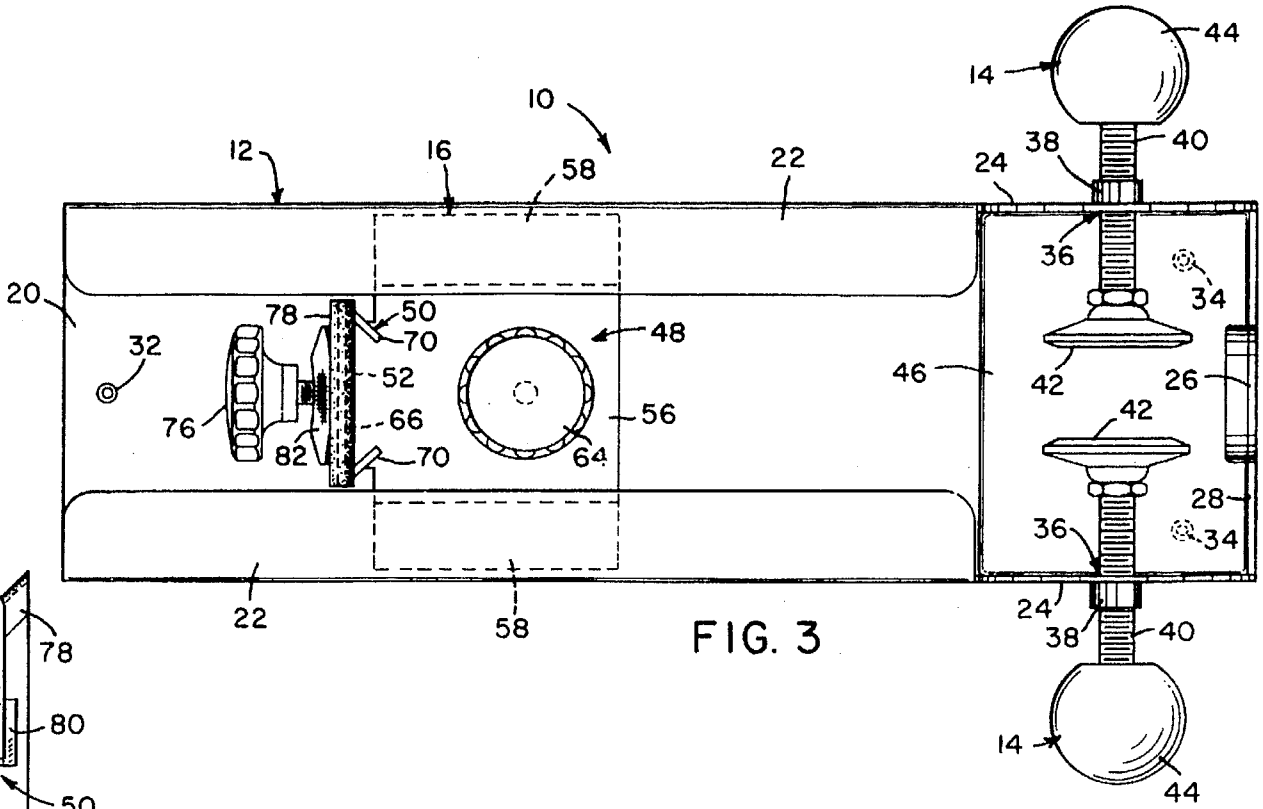
FIG. 3 is top plan view of the handgun holder.

Referring now to the FIGS., a handgun holder in accordance with the present invention is shown at 10. The handgun holder 10 includes an elongated base 12 having a generally U-shaped cross-section. One end of the base 12 carries a pair of clamping members 14 adapted for vise-like engagement with the handle or grip of a handgun (not shown). Adjacent the clamping members 14, a support member 16 is slidably positioned within the base 12 for supporting the handgun barrel.

The base 12 is formed by bending a generally rectangular piece of sheet metal into the desired configuration. As shown, the base 12 includes a pair of opposed side walls 18 extending at right angles from an intermediate, bottom wall 20. A pair of inwardly-directed ribs 22 are integrally formed with the upper ends of the side walls 18 and are positioned parallel to the bottom wall 20. Adjacent the ribs 22 are a pair of upwardly-directed fins 24 which serve as integral extensions to the side walls 18. Between the fins 24, an integral flange 26 extends upwardly from the end 28 of the bottom wall 20.

The base 12 is preferably provided with a number of relatively small openings. For lightness, the length of each side wall 18 includes a series of aligned bores 30. The bottom wall 20, on the other hand, has countersunk bores 32 and 34 at its opposed ends for attaching the base 12 to a supporting surface by means of threaded fasteners (not shown). Finally, each of the fins 24 is furnished with a bore 36 within which is affixed an internally-threaded nut 38.

Each nut 38 rotatably carries a correspondingly threaded rod 40 comprising part of one clamping member 14. To the end of each rod 40, carried between the fins 24, is pivotally secured a resilient pad 42 for transmitting clamping force to the sides of the handgun handle. To the opposite end of each rod 40 is secured a knob 44 by means of which such may be rotated within a nut 38 and the corresponding pad 42 transversely moved.

A rubber pad 46 is adhesively secured to the bottom wall 20 between the fins 24 and to the integral flange 26. The pad 46 absorbs recoil forces and prevents scratching of a handgun handle when a handgun, positioned in the holder 10, is discharged. Further, the end 45 of pad 46 acts like a bumper to keep the barrel support member 16 at distance from the clamping members 14 so that the typical handgun will always be provided with balanced support by the holder 10.

The barrel support member 16 includes a slide portion 48 and a levelling portion 50 adjustably mounted thereon. The position of the slide portion 48 is longitudinally adjustable relative to the base 12. The position of the levelling portion 50, on the other hand, is vertically adjustable relative to the base 12. Thus, by moving the slide and levelling portions 48 and 50, the configuration of the holder 10 may be varied to accommodate handguns of different dimensions.

Figure 4:
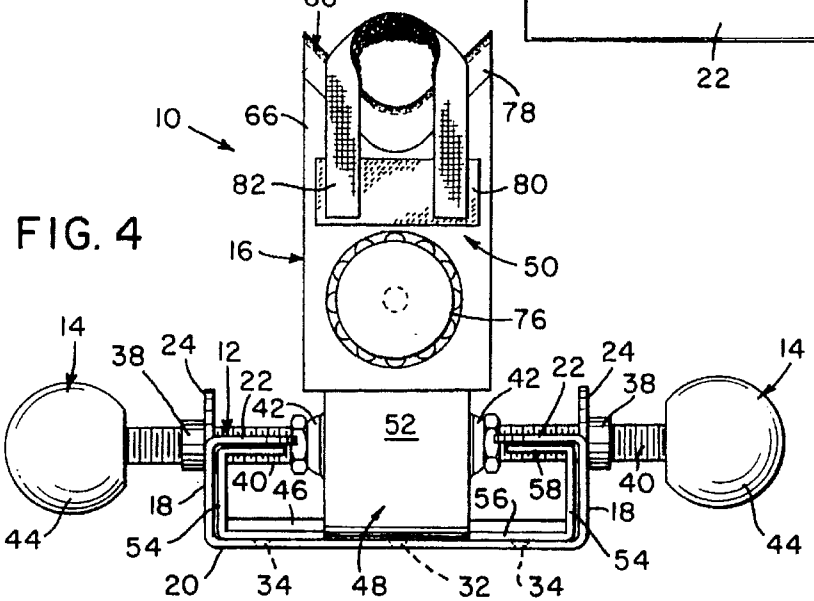
FIG. 4 is a front end view of the handgun holder.

The slide portion 48 comprises a metallic sheet formed so as to include both a support plate 52 and a pair of side walls 54 extending orthagonally from an intermediate, bottom wall 56. A pair of inwardly-directed ribs 58 are integrally formed with the upper ends of the side walls 54 and they are parallel to the bottom wall 56. As may best be seen in FIG. 4, the side walls 54, bottom wall 56 and ribs 58 are dimensioned to fit closely within corresponding parts of the base 12. The support plate 52, however, is sized to extend outwardly from between the ribs 22 of the base 12.

An internally-threaded nut 60 is affixed in a bore 62 located in the center of the bottom wall 56 of the slide portion 48. A set screw 64 is rotatably secured within the nut 60. Rotation of the screw 64 so as to extend such from the bottom of the slide portion 48 against the bottom wall 20 of the base 12 acts to bias the ribs 58 and 22 together and lock the slide portion in the desired position within the base 12.

The levelling portion 50 preferably comprises a metallic sheet formed so as to include a travelling plate 66, for positioning adjacent one side of the support plate 52, with a V-shaped notch 68 at its upper end. A pair of integral retaining fins 70 extend from the sides of travelling plate 66 and enclose the lateral edges of the support plate 52 to slidably secure the portions 48 and 50 together.

An internally-threaded nut 72 is set in a bore 74 in the travelling plate 66. A set screw 76, rotatably carried by the nut 72, provides means for locking the adjustable levelling portion 50 into a desired position on the support plate 52 of the sliding portion 48.

A press-fit, elastomeric pad 78 lines the V-shaped notch 68 and provides a protective contact surface upon which the barrel of a handgun may rest. Similar pads (not shown) may be used to cover the upper edges of the fins 24 and reduce the likelihood of scratching a handgun as it is positioned within the holder 10.

The barrel of a handgun may be readily locked within the V-shaped notch 68 of the levelling portion 50. For this purpose, a piece of "Velcro" hook material 80 is adhesively secured to the travelling plate 66. The hook material 80 cooperates with a strip of "Velcro" pile material 82 including a dense mat of coiled threads. By pressing the ends of the pile strip 82 into cooperative engagement with the hook piece 80, a releasable loop is formed which may be fastened around the barrel of a handgun located in the notch 68.

To use the handgun holder 10, the base 12 is initially positioned upon a stable supporting surface like the top of a heavy table. If the holder 10 is to be used for testing the accuracy of a handgun, it is preferable that threaded fasteners be located in the countersunk bores 32 and 34 to prevent recoil forces from moving the holder when the handgun is fired. Of course, the use of such threaded fasteners is not necessary if the handgun is to be merely cleaned or repaired without being discharged.

The handgun is inserted between the pair of clamping members 14 so that its handle abuts the rubber pad 46, adjacent the recoil-absorbing flange 26, and its barrel is substantially aligned with the longitudinal axis of the base 12. By rotating the knobs 44, the pads 42 at the ends of the threaded rods 40 are brought into clamping engagement with the handgun handle.

The positions of the slide and levelling portions, 48 and 50 respectively, of the barrel support member 16 are adjusted so that the handgun barrel is supported at a desired inclination within the V-shaped notch 68. After the adjustments are made, they are locked in place by turning the set screws 64 and 76. Finally, the handgun barrel is secured within the notch 68 by means of the hook-and-loop fasteners 80 and 82 with the handgun now in a position for servicing or firing. Access to the handgun may now be gained from essentially all sides thereof.

During test firing of the handgun in the holder 10, lateral adjustments of the position of the handgun barrel may be required. These adjustments are simply accomplished by rotating the knob 44 of one clamping member 14 so that its associated pad 42 slightly disengages the handle of the handgun and then rotating the knob of the other clamping member 14 to bring both pads 42 back into tight engagement with the handle. Thus, the base 12 need not be moved to aim the handgun and remains as a fixed reference throughout use.

While the inventive handgun holder has been described with a high degree of particularity, it will be appreciated by those skilled in the art that numerous modifications and substitutions may be made thereto. Therefore, it is to be understood that the present invention is not limited to the sole embodiment described above, but encompasses any and all embodiments within the scope of the following claims.

I claim:

1. A handgun holder, comprising:

an elongated base having a U-shaped cross-section, said base including an intermediate, bottom wall and a pair of first side walls each having an inwardly projecting free edge;

a pair of clamping members rotatably secured to said first side walls in opposition to one another for engaging and clamping the handle of a handgun therebetween;

a support member having a lower end slidable on said intermediate, bottom wall between said first side walls and having an upper end with a notch for receiving the barrel of the handgun; and, a first set screw rotatably secured to said lower end of said support member for engaging said intermediate, bottom wall of said base and moving said lower end of said support member into engagement with said inwardly projecting free edges of said first side walls so as to selectively fix the position of said support member on said base.

2. The handgun holder according to claim 1 wherein said elongated base is integrally formed from sheet metal.

3. The handgun holder according to claim 1 wherein each said inwardly projecting free edge extends orthagonally from an associated one of said first side walls.

4. The handgun holder according to claim 1 further comprising a recoil flange extending from said elongated base between said first side walls for engaging the handle of a handgun and absorbing recoil forces delivered thereby.

5. The handgun holder according to claim 1 wherein each of said clamping members includes:

a threaded rod rotatably secured to one of said first side walls of said base, said threaded rod having a first end disposed between said first side walls and a second end external to said first side walls;

a resilient pad secured to said first end of said threaded rod for selectively engaging the handle of the handgun; and, a knob secured to said second end of said threaded rod.

6. The handgun holder according to claim 1 wherein said lower end of said support member includes a pair of second side walls, each having an inwardly projecting free edge, slidably engaged with said pair of first side walls.

7. The handgun holder according to claim 6 wherein said lower end of said support member further includes:

a second intermediate wall joining said pair of second side walls and having a threaded opening for receiving said first set screw; and, a second pair of ribs integral with said pair of second side walls and extending at right angles therefrom in a common plane parallel to said second intermediate wall, and each of said second pair of ribs defining one said inwardly projecting free edge.

8. The handgun holder according to claim 1 wherein said upper end of said support member is telescopically secured to said lower end thereof and said handgun holder further comprises a second set screw rotatably secured to said support member for selectively fixing the position of said upper end relative to said lower end.

9. The handgun holder according to claim 1 further comprising hook-and-loop fastening means for retaining the barrel of the handgun within said notch in said upper end of said support member.

10. A handgun holder, comprising:

an elongated base including:

a first bottom wall;

a first pair of side walls extending perpendicularly from said first bottom wall; and, a first pair of ribs spaced from said first bottom wall and extending perpendicularly from said first pair of side walls;

a pair of clamping members rotatably secured to said first pair of side walls at one end of said base for clamping the handle of a handgun therebetween;

a support member having a lower end slidably secured between said first pair of side walls and an upper end with a notch for receiving the barrel of a handgun; and, a first set screw rotatably fastened to said support member for engaging said first bottom wall and for moving said support member into engagement with said first pair of ribs so as to selectively fix the position of said support member on said base.

11. The handgun holder according to claim 10 wherein said base further includes a recoil flange extending outwardly from one end of said first bottom wall adjacent said pair of clamping members for engaging the handle of a handgun and absorbing recoil forces delivered thereby.

12. The handgun holder according to claim 10 wherein each of said clamping members includes:

a threaded rod rotatably secured to one of said first pair of side walls, said threaded rod having a first end disposed between said first pair of side walls and a second end external to said first pair of side walls;

a resilient pad secured to said first end of said threaded rod for selectively engaging the handle of the handgun; and, a knob secured to said second end of said threaded rod whereby rotation of said knob in one direction laterally extends said resilient pad toward the handle of the handgun in said holder and rotation of said knob in the other direction retracts said resilient pad from the handle of the handgun.

13. The handgun holder according to claim 10 wherein said lower end of said support member includes a second pair of side walls, each having an inwardly projecting free edge, slidably engaged with said first pair of side walls.

14. The handgun holder according to claim 13 wherein said lower end of said support member further includes:

a second bottom wall joining said second pair of side walls and having a threaded opening therein for receiving said first set screw; and, a second pair of ribs integral with said second pair of side walls and extending at right angles therefrom in a common plane parallel to said second bottom wall.

15. The handgun holder according to claim 10 wherein said upper end of said support member is telescopically secured to said lower end thereof and said handgun holder further comprises a second set screw rotatably secured to said support member for selectively fixing the position of said upper end relative to said lower end.

16. The handgun holder according to claim 10 further comprising means for retaining the barrel of a handgun within said notch in said upper end of said support member.

17. A handgun holder, comprising:

an elongated base including:

a first bottom wall;

a first pair of side walls integral with said first bottom wall and extending upwardly therefrom; and, a first pair of ribs integral with said first pair of side walls and extending inwardly therefrom;

a pair of threaded fasteners rotatably secured to said first pair of side walls at one end of said elongated base for clamping the handle of a handgun therebetween;

a support member slidably secured between said first pair of side walls and extending outwardly from said base, said support member having a notch in its free end for receiving the barrel of a handgun; and, a first set screw rotatably fastened to said support member for contacting said first bottom wall and moving said support member into engagement with said first pair of ribs so as to selectively fix the position of said support member on said base.

18. The handgun holder according to claim 17 wherein said support member comprises:

a slide portion slidably secured between said first pair of side walls, said slide portion including:

a second bottom wall adapted for positioning on said first bottom wall and having a threaded opening for receiving said first set screw:

a second pair of side walls integral with said second bottom wall and extending upwardly therefrom;

a support plate integral with said second bottom wall and extending upwardly therefrom, said support plate being located between said second pair of side walls; and, a second pair of ribs integral with said second pair of side walls and extending inwardly therefrom; and, a levelling portion telescopically secured to said slide portion, said levelling portion including:

a travelling plate for positioning adjacent said support plate and having said notch therein;

a pair of fins integral with said travelling plate, said fins extending from the sides of said travelling plate and enclosing the sides of said support plate; and, a second set screw rotatably secured to said travelling plate for selectively fixing the position of said travelling plate on said support plate.

19. The handgun holder according to claim 20 further comprising fastening means on said levelling portion for retaining the barrel of the handgun within said notch.

* * * * *